United States Patent [19]

Kasu et al.

[11] 3,968,744

[45] July 13, 1976

[54] SELF-DAMPING UNITARY PRINT HAMMER FOR HIGH SPEED PRINTERS

[75] Inventors: Abdul L. Kasu, Westland; William J. Basse, Plymouth, both of Mich.

[73] Assignee: Burroughs Corporation, Detroit, Mich.

[22] Filed: Mar. 3, 1975

[21] Appl. No.: 554,579

[52] U.S. Cl. ..... 101/93.02; 101/93.48

[51] Int. Cl.[2] ..... B41J 9/42

[58] Field of Search 101/93.02, 93.48, 93.29–93.36, 101/110, 111; 335/277; 197/42

[56] References Cited

UNITED STATES PATENTS

| | | | |
|---|---|---|---|
| 3,504,623 | 4/1970 | Staller | 101/93.33 |
| 3,630,142 | 12/1971 | Fulks et al. | 101/93.33 |
| 3,635,156 | 1/1972 | Krebs et al. | 101/93.33 |
| 3,636,868 | 1/1972 | Johnston et al. | 101/93.02 X |
| 3,670,647 | 6/1972 | Funk et al. | 101/93.02 X |
| 3,714,892 | 2/1973 | Perry | 101/93.48 |
| 3,726,213 | 4/1973 | Herbert | 101/93.33 |
| 3,735,698 | 5/1973 | Lenders et al. | 101/93.29 X |
| 3,780,648 | 12/1973 | Curtiss et al. | 101/93.02 |

OTHER PUBLICATIONS

McCarty, IBM Technical Disclosure Bulletin, vol. 15, No. 3, Aug. 1972, pp. 824–825.

*Primary Examiner*—Edgar S. Burr
*Assistant Examiner*—Edward M. Coven
*Attorney, Agent, or Firm*—Edwin W. Uren; Kevin R. Peterson

[57] ABSTRACT

A light weight molded print hammer is provided with a pair of integrally formed and interconnected flexure members and an integrally formed rigid back-up member spaced from said flexure members, said print hammer being designed for pivotal mounting in a line priner in cooperable relationship with a solenoid and a printing position thereof, an armature carried by the molded print hammer being magnetically attracted upon energization of the solenoid to pivotally activate the rigid back-up member and to thereby translatably propel the pair of flexure members into free flight in the direction of the printing position, a metallic impact tip carried by one of the flexure members being translatably impacted into printing contact with a print media, inked ribbon and selectively positioned type character disposed in the printing position, the rigid back-up member and its spaced relationship relative to a contiguous one of the flexure members serving to absorb and to dampen the rebounding shock caused by the printing contact.

9 Claims, 3 Drawing Figures

SELF-DAMPING UNITARY PRINT HAMMER FOR HIGH SPEED PRINTERS

BACKGROUND OF THE INVENTION

Known print hammer assemblies commonly used in high speed line printers have generally provided flexurally mounted interposer-type hammers and separate damping means associated with armature-actuators that are cooperably disposed relative to the hammers. In these known assemblies a stationary solenoid is generally provided for each of the hammers in the line printer, the energization of the solenoid serving to magnetically attract the armature-actuator to impact the hammer into printing contact with a print media, ribbon and selectively positioned type character located in the printing position. Following the impacting of the hammer against the selectively positioned type character, which may be arranged on a drum, chain or band, the rebounding effect of the impacting of the hammer has generally been absorbed and dampened by separate stationary damping means such that the hammer will not rebound against the media and type character to produce what is known as "shadow printing".

Typical of these known print hammer assemblies are those disclosed in U.S. Pats. Nos. 3,335,659; 3,351,006 and 3,670,647. In U.S. Pat. No. 3,335,659 to Schacht et al. the print hammer assembly is comprised of a flexurally mounted print hammer, a pair of integrally formed armature yokes disposed in cooperating relationship with a stationary solenoid, and separate elastic damping means that is effectively assisted by prolonging the energization of the solenoid beyond the instant of print hammer impact.

In U.S. Pat. No. 3,351,006 to Belson the print hammer assembly is comprised of a flexurally mounted print hammer, a separate pivotal armature actuator associated with a stationary solenoid, and separate damping means consisting of a magnet that dampens the return impacting force of the actuator against an associated backstop. In U.S. Pat. No. 3,670,647 to Funk et al., the print hammer assembly is comprised of a flexurally mounted print hammer, a separate pivotally mounted armature actuator, and separate elastic damping means which, as in Schacht et al., is effectively assisted by prolonging the energization of the solenoid beyond the instant of print hammer impacting.

Although these known print hammer assemblies have proven to be effective when used in the particular line printer environments for which they were intended, and particularly in relatively high priced data processing printing peripherals, they have been found to be too expensive for use in lower priced line printers wherein the quality of the printed result is not to be sacrificed, but wherein initial and maintenance economies are held to be controlling. It has been found, for example, that significant economies in initial manufacturing costs cannot be achieved through the perpetuation of the print hammer assembly concept described supra, wherein the essential elements of a print hammer, an armature actuator, and damping means are separately manufactured and assembled together either directly into the line printer or into subassemblies to be later installed within the printer. Characteristically, the print hammer assembly concept has necessitated the employment of parts of substantially greater size and weight than would be functionally required by the assembly itself, but that would lend themselves to various machining and assembly operations in the manufacturing facility. It will also be apparent that the practice of prolonging the energization of the solenoid beyond the instant of print hammer impact, although effective as an aid or substitute for the damping means element, serves to increase the duty cycle of the solenoid and thus to interfere with the realization of optimized maintenance economies.

SUMMARY OF THE INVENTION

In view of the above described limitations and disadvantages of known print hammer assemblies, it is an important object of the present invention to provide a low cost unitary print hammer that encompasses all of the essential elements including the flexurally mounted hammer, the armature-actuator and the damping means, and wherein manufacturing economies may be realized in the elimination of expensive machining and assembly operations.

It is another important object of the present invention to provide a multi-element print hammer wherein the integrally formed elements thereof are of minimal size and weight, and of such size and weight as would be dictated alone by the functional demands that are to be imposed upon the several elements.

It is still another object of the present invention to provide a unitary print hammer wherein the damping element thereof is effective for absorbing and damping the return rebounding of the flexurally mounted hammer without increasing the duty cycle of the actuating solenoid, as by prolonging the energization of the solenoid beyond the instant of hammer impact.

An important aspect of the present invention is the use of a thermoplastic material for moldably forming and accommodating the essential elements of a print hammer into a unitary printing device, such device including a hammer in the form of a metallic impact tip, a pair of integrally formed flexure members carrying said tip and providing flexural mounting therefor, a rigid integrally formed back-up member spaced from said flexure members and providing or accommodating the damping element of said device, and an integrally formed channeled leg extremity for receivably accommodating a metallic armature to be cooperably disposed relative to an associated solenoid stationarily mounted in a line printer upon pivotal mounting of the device therein.

Another important aspect of the present invention is the dual role that is played by the rigid back-up member during each printing cycle, said back-up member being effective to abuttably propel the flexurally mounted metallic impact tip into free flight into contact with the selectively positioned type character, upon energization of the solenoid, and effective also to dampen the rebounding of the flexure members and metallic tip following the printing impact as the unitary printing device is resiliently returned to its non-print home position, such damping effect being accommodated either as a consequence of the spaced-apart relationship of the back-up member itself, relative to the flexure members, or as a consequence of a damping material fixedly interposed between said back-up member and a contiguous one of said pair of flexure members.

BRIEF DESCRIPTION OF THE DRAWINGS

These and other objects, aspects and advantages of the invention will become more readily apparent from the following description when read in conjunction with the accompanying drawing figures, in which.

DESCRIPTION OF THE PREFERRED EMBODIMENT

Figure 2:
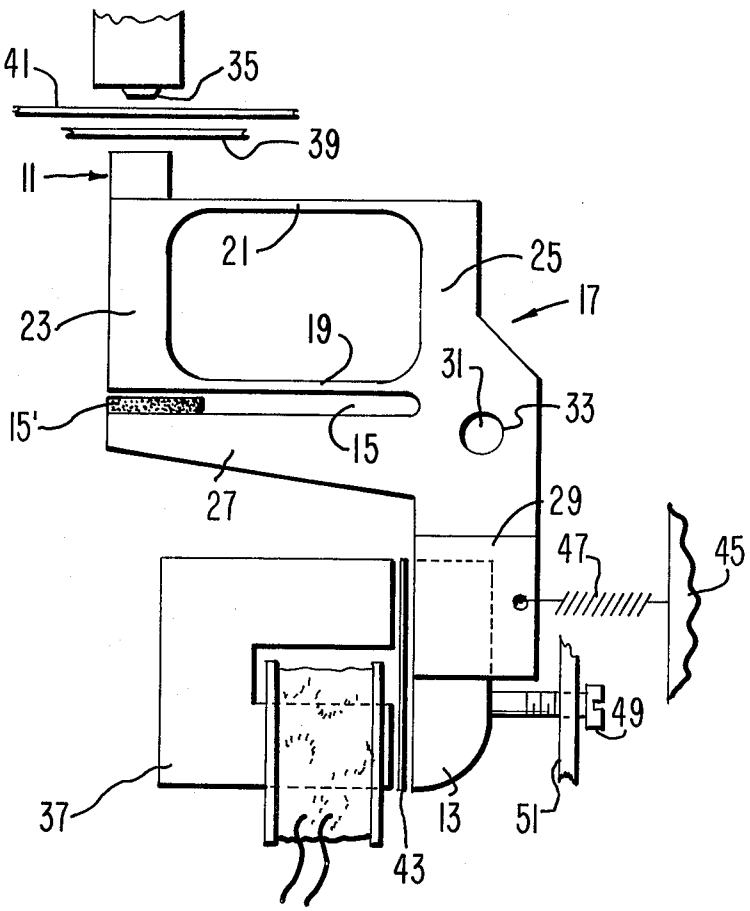
FIG. 2 is a diagrammatic illustration showing a second species of the inventive print hammer disposed in cooperating relationship with the line printer elements of FIG. 1.

As suggested in the foregoing, the present invention resides in the provision of a unitary print hammer moldably formed of a thermoplastic material and comprising all of the essential elements of known and commonly used print hammer assemblies, such essential elements including a flexurally mounted hammer or impact tip designated at 11, an armature actuator 13, and damping means 15 (FIG. 1) or 15' (FIG. 2) as distinguished infra in connection with a description of two separate embodiments of the invention. A body portion 17 of the unitary print hammer is comprised of first and second flexure members 19 and 21, interconnecting members 23 and 25 connecting the first and second flexure members, a rigid back-up member 27, and a channeled leg extremity 29 within which the armature actuator 13 is fixedly received.

As will be apparent from the drawing figures, the first flexure member 19 and second flexure member 21 provide flexural mounting for the impact tip 11 and are parallelly connected by the interconnecting members 23 and 25. As also will be apparent from the drawing figures, the rigid back-up member 27 is parallelly disposed relative to the flexure members 19 and 21, and is spaced a predetermined distance from the contiguous first flexure member 19, the purpose for such spacing being hereinafter described in greater detail.

Although only one unitary print hammer is shown in the drawings, a plurality of such hammers may be installed in a line printer, the number of hammers required depending upon the number of character positions comprising a printing line, and the number of type characters of the print drum or chain that would be disposed coincidentally in the printing position of the line printer, which is commonly 132 type character positions. The required number of print hammers would be installed in side-by-side relationship in the line printer by means of a shaft 31 fixed to the side frames thereof, such shaft being received within a pivot aperture 33 formed in the body portion 17 of each of the unitary print hammers. Each of the print hammers would be disposed in predetermined laterally fixed relationship along the shaft 31 with the impact tip 11 and armature actuator 13 thereof disposed in cooperating relationship with a corresponding type character position and solenoid, respectively, the solenoids 37 being stationarily positioned in parallel side-by-side relationship within the line printer by any suitable means associated with frame members of the line printer. It will accordingly be apparent that upon energization of a solenoid 37, the armature actuator 13 of the corresponding print hammer would be magnetically attracted into contact with the solenoid, the body portion 17 pivotally activated in a clockwise direction on the shaft 31, and the impact tip 11 translatably activated into contact with the print media 39, the inked ribbon 41, and a selectively positioned type character 35. A continuous mylar or urethane shim 43 may be supported by frame members of the line printer with an adjacent surface thereof disposed in contacting relationship with the pole pieces of the solenoids 37, such continuous shim serving to provide an air gap between the actuators 13 and the pole pieces of the solenoids 37 to thereby prevent the armatures from becomming magnetically locked to the solenoids. This arrangement, however, is not a part of the present invention. Each of the inventive unitary print hammers assembled in a line printer and pivotally mounted on the shaft 31 would be resiliently biased in a counterclockwise direction as by a return spring 47 connected to the leg extremity 29 thereof and anchored at the other end, for example, by a first frame member 45. An adjustment screw 49 operatively supported by a second frame member 51 of the line printer may also be provided each of the unitary print hammers, for adjustably defining the home position of the print hammer. Such adjustment screw 49 would serve as a means of varying the power stroke of the unitary print hammer.

Figure 1:
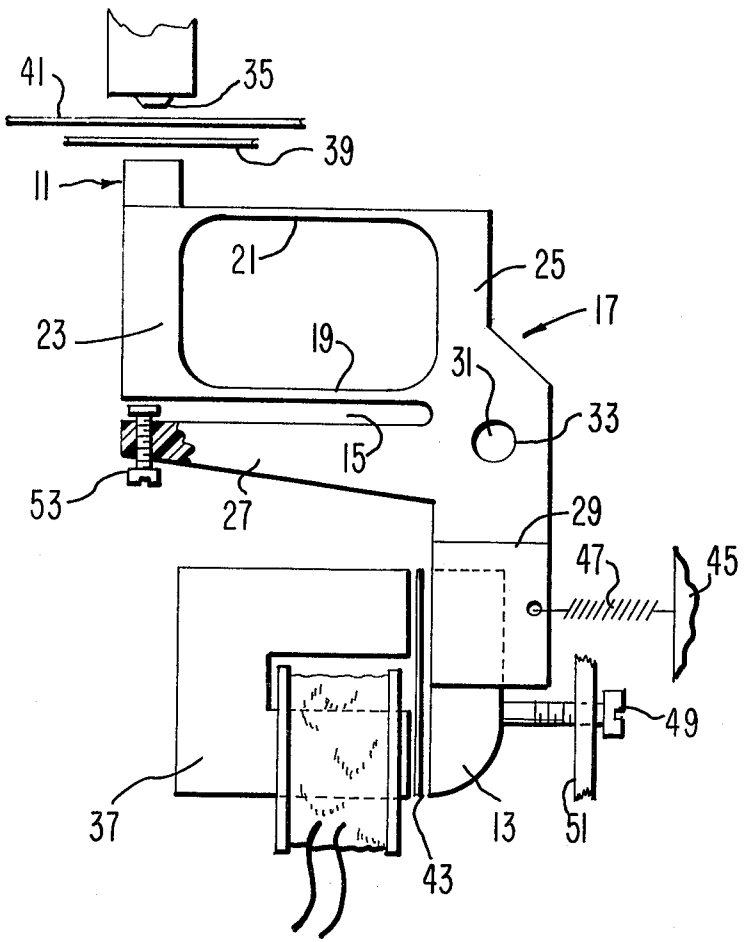
FIG. 1 is a diagrammatic illustration showing a first species of the inventive print hammer disposed in cooperating relationship with various elements of a typical line printer.
Figure 3:
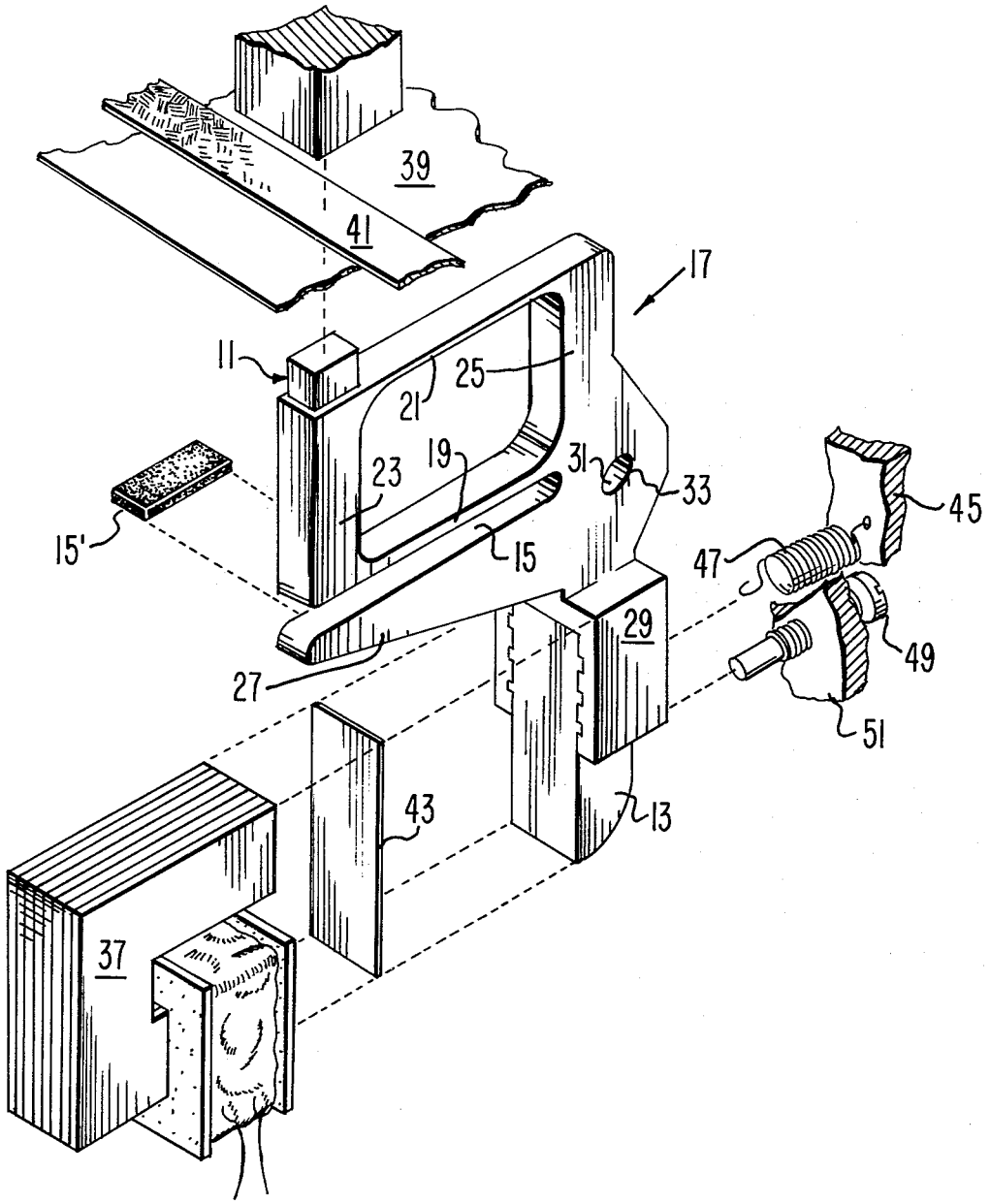
FIG. 3 is a perspective view of the print hammer of FIG. 2 showing the integrally formed members and inserts thereof in greater detail.

In the embodiment or species illustrated in FIG. 1, the rigid back-up member 27 is shown to include a second adjustment screw 53. By adjusting this second adjustment screw 53, the abuttable propulsion of the flexure members 19, 21 and impact tip 11 into printing contact with the selectively positioned type character 35 may be varied with respect to flight time. The damping means of the FIG. 1 embodiment, as mentioned supra, is in the form of the predetermined spaced apart distance 15 between the rigid back-up member 27 and the first flexure member 19. This spaced apart distance 15 serves to absorb the return rebounding of the impact tip 11, and flexure members 21 and 19, as the body portion 17 is returned to its home position by the return spring 47 upon de-energization of the solenoid 37.

The damping means of the embodiment illustrated in FIG. 2, as also mentioned supra in connection with damping means 15', is in the form of a resilient damping material such as butyl rubber fixed to the upper surface of the back-up member 27 by means of a suitable adhesive substance such as epoxy resin. This resilient damping material, along with the spaced apart distance between the back-up member 27 and first flexure member 19, serves to absorb the return rebounding shock of the impact tip 11 and flexure members following the printing contact and during the return counterclockwise activation of the body portion 17.

The impact tip 11, which may be made of hardened steel, and the armature actuator 13, which may be made of soft iron, are constrictively secured within the upper extremity of the interconnecting member 23 and the channel of the channeled leg extremity 29, respectively, during the moldable formation of the inventive print hammer device, and particularly during the cooling of the thermoplastic material with the armature actuator 13 disposed in the channel of the leg extremity 29 and with the impact tip 11 disposed in a recess formed in the upper extremity of the interconnecting member 23.

OPERATION

It can be seen from FIG. 1 that energization of the solenoid 37 will serve to magnetically attract the armature actuator 13 into contact with the pole pieces thereof, and that such magnetic attraction will pivotally activate the body portion 17 in a clockwise direction on the shaft 31, the rigid back-up mamber 27, moving in unison with the body portion 17, serving to abuttably and translatably propel the flexure members 19 and 21 in the direction of the selectively positioned type character 35, the impact tip 11 being thereby driven into printing contact with the print media 39, the inked ribbon 41 and the type character 35. Following the printing contact of the impact tip 11, the solenoid 37 is de-energized and the body portion 17 and back-up member 27 are returned to their home positions as defined by the operative extremity of the first adjustment screw 49. During this return activation of the print hammer device, the rebounding overshoot of the impact tip 11 and flexure members 21 and 19 is absorbed by the spaced apart distance 15 between the first flexure member 19 and the back-up member 27, or, more particularly, by the adjustably defined spaced apart distance between the first flexure member 19 and the operative end of the second adjustment screw 53. Contraction of this spaced apart distance between the first flexure member 19 and the rigid back-up member 27 serves to dampen the rebounding of the impact tip 11 and to prevent the return rebounding of the tip 11 into partial contact with the type character 35.

In the case of the FIG. 2 embodiment, energization of the solenoid 37 will serve to pivotally activate the body portion 17 and back-up member 27 in a clockwise direction, and to abuttably and translatably propel the flexure members 19, 21 and the impact tip 11 into printing contact with the selectively positioned type character 35, in like manner to that described supra in connection with the FIG. 1 embodiment. Following the printing contact of the impact tip 11 and de-energization of the solenoid 37, the body portion 17 and back-up member 27 are returned to their home positions, the rebounding overshoot of the impact tip 11 and flexure members 21 and 19 is abosrbed by the damping material 15' and by the contraction of the spaced apart distance 15 between the first flexure member 19 and rigid back-up member 27, whereby the return rebounding of the impact tip 11 relative to the type character 35 is prevented.

Whereas two separate embodiments of the inventive unitary print hammer have been described in considerable detail, it will be apparent that various changes and modifications may be made by those skilled in the art, both with respect to the arrangement of the various elements and the materials used therein, without departing from the true spirit and scope of the invention, such spirit and scope being defined with greater particularlity by the appended claims.

What is claimed is:

1. A self-contained print hammer for rotatable impacting use in association with a solenoid and a print station in a line printer, said print hammer being rotatably effective for producing a printed output in said print station and for preventing an overprint of said printed output, said self-contained print hammer comprising:

a. an actuator formed of a metallic material and operatively associated with said solenoid, b. an impactor formed of a metallic material and effective for producing said printed output in said print station, c. thermoplastic body means comprising:

first and second spaced apart flexure members interconnected at corresponding ends thereof by an interconnecting member, said interconnecting member having a recess constrictively securing and supporting said impactor, a first rigid member disposed in parallel and predetermined spaced relationship with said first flexure member on the side thereof opposite said second flexure member and said impactor, said first rigid member operating in support of said impactor in producing said printed output and in opposition to said impactor in preventing said overprint of said printed output, and a second rigid member disposed on the side of said thermoplastic body means remote from said interconnected first and second flexure members, said second rigid member being provided with a recess constrictively securing and supporting said actuator in cooperable relationship with said solenoid, and d. a dampener associated with said impactor and comprising:

said predetermined spaced relationship between said first rigid member and said first flexure member, and a damping material fixed to said first rigid member on the surface thereof adjacent said first flexure member, whereby upon the production of said printed output in said print station the kinetic energy generated in said impactor and in said interconnected first and second flexure members is absorbed by the contraction of the spaced distance comprising said predetermined spaced relationship between said first rigid member and said first flexure member and by the damping compression of said damping material.

2. A self-contained print hammer for impacting use in association with a print station and a solenoid in a line printer, said print hammer comprising:

a. a rotatable body portion formed of a thermoplastic material and having an aperture for rotatably mounting said print hammer relative to said print station and said solenoid, b. a flexurally mounted metallic impact tip supported and carried by said rotatable body portion for cooperation with said print station, c. a rigid member forming part of said rotatable thermoplastic body portion and disposed in cooperating relationship with said flexurally mounted impact tip, d. an armature actuator formed of a metallic material supported and carried by said rotatable body portion for cooperation with said solenoid, and e. damping means associated with said rigid member and disposed in cooperating relationship with said flexurally mounted impact tip, said flexural mounting of said impact tip being effectuated by means of:

a first flexure member forming part of said thermoplastic body portion and disposed in parallel and predetermined spaced relationship with said rigid member, a second flexure member forming part of said thermoplastic body portion and disposed in parallel relationship with said first flexure member on the side thereof opposite said rigid member, and an interconnecting member forming part of said thermoplastic body portion and connecting said first and said second flexure members, said interconnecting member carrying and supporting said impact tip in cooperating relationship with said print station.

3. The self-contained print hammer defined in claim 2 wherein said impact tip is made of hardened steel and is constrictively secured within said interconnecting member adjacent said second flexure member.

4. The self-contained print hammer defined in claim 3 wherein said armature actuator is formed of soft iron and is constrictively secured within a recess formed in said thermoplastic body portion on the side thereof remote from said interconnecting member and said impact tip and disposed in contiguous relationship with said solenoid.

5. The self-contained print hammer defined in claim 4 whereing said damping means is in the form of the spaced distance comprising said predetermined space relationship between said rigid member and said first flexure member, said spaced distance contracting to absorb the kinetic energy generated in said interconnecting member and said first and said second flexure members upon the occurrence of said impacting of said impact tip in said print station to thereby prevent the return rebounding of said impact tip following said impacting.

6. The self-contained print hammer defined in claim 5 wherein said rigid member is provided with an adjusting screw for varying the effective spaced distance between said rigid member and said first flexure member and to thereby provide for a variation in the timing of said impacting of said impact tip in said print station.

7. The self-contained print hammer defined in claim 4 wherein said damping means comprises:

a. said predetermined spaced relationship between said rigid member and said first flexure member, and b. a damping material affixed to said rigid member on the surface thereof adjacent said first flexure member.

8. The self-contained print hammer defined in claim 7 wherein said damping material is butyl rubber and is fixed to the surface of said rigid member by an adhesive material.

9. The self-contained print hammer defined in claim 8 wherein said adhesive material for fixing said damping material to the surface of said rigid member is epoxy resin.

* * * * *